United States Patent [19]

Cillario

[11] Patent Number: 4,472,895

[45] Date of Patent: Sep. 25, 1984

[54] PACKAGE HAVING A MESSAGE-RECEIVING PART

[75] Inventor: Lorenzo Cillario, Alba, Italy

[73] Assignee: Ferrero S.p.A., Alba, Italy

[21] Appl. No.: 426,219

[22] Filed: Sep. 28, 1982

[30] Foreign Application Priority Data

Jun. 28, 1982 [IT] Italy ..... 53455/82[U]

[51] Int. Cl.[3] ..... B65D 25/36; B65D 23/14

[52] U.S. Cl. ..... 40/312; 229/87 R

[58] Field of Search ..... 229/87 R; 40/312; 206/459

[56] References Cited

U.S. PATENT DOCUMENTS

| | | | |
|---|---|---|---|
| 385,197 | 6/1888 | Nolley | 229/87 R |
| 2,033,526 | 3/1936 | Kinkenon | 229/87 R |
| 2,047,264 | 7/1936 | Halligan | 206/459 |
| 2,167,637 | 8/1939 | Claff | 40/312 |
| 2,192,423 | 3/1940 | Ward et al. | 40/312 |
| 2,194,220 | 3/1940 | Elder | 40/312 |
| 3,087,605 | 4/1963 | Kester | 40/312 |
| 3,126,660 | 3/1964 | Meyers | 40/312 |
| 3,407,781 | 10/1968 | Ardire et al. | 206/459 |
| 3,497,982 | 3/1970 | Schulz | 40/312 |
| 4,326,665 | 4/1982 | Scott | 229/87 R |

*Primary Examiner*—Stephen P. Garbe

*Attorney, Agent, or Firm*—Bernard, Rothwell & Brown

[57] ABSTRACT

The device comprises a strip element or band which can be wrapped around a package, the strip element having an integral label for receiving messages. The label may include an integral flap which can be folded over a message - bearing part of the label.

3 Claims, 3 Drawing Figures

PACKAGE HAVING A MESSAGE-RECEIVING PART

The present invention relates to devices for appending messages to boxes and similar packaged products, particularly candy products.

The device according to the invention is characterised in that it comprises a strip element which can be wrapped around the package and in that this element incorporates a label constituting a surface for receiving a message.

The invention makes it particularly easy to append written messages, such as, for example, greetings and addresses, to packaged products intended to be offered as presents.

Further advantages of the present invention will become clear from the following description, given purely by way of non-limiting example, with reference to the appended drawings, in which.

Figure 1:
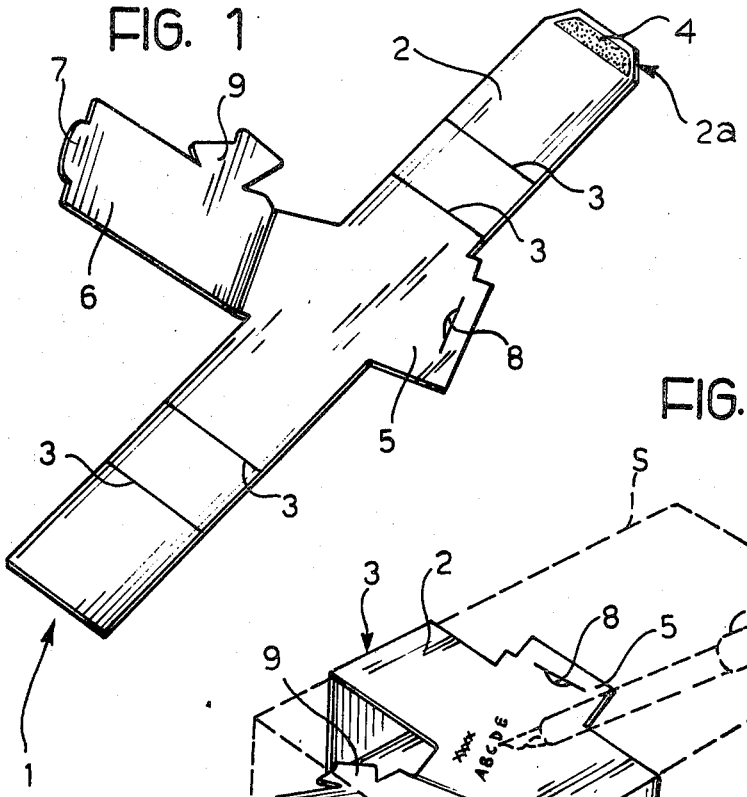
FIG. 1 is a perspective view of a device according to the invention.
Figure 2:
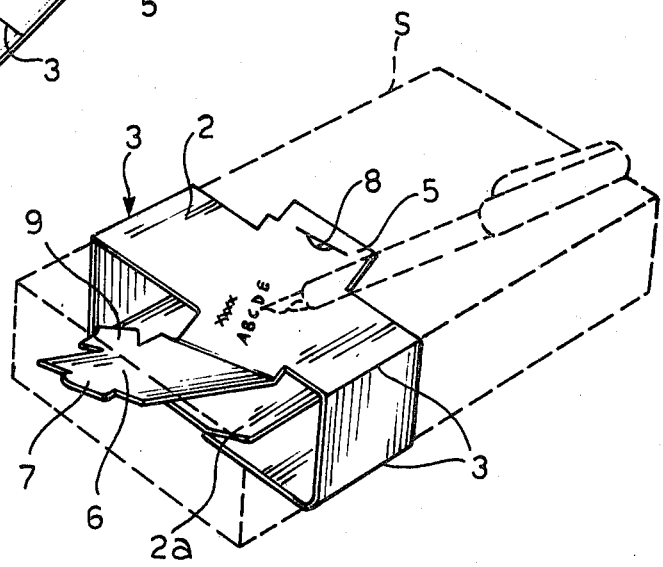
FIGS. 2 and 3 are perspective views of a parallelepiped shaped package illustrating two successive stages in the use of the device according to the invention shown in FIG. 1 for appending written messages to the package.
Figure 3:
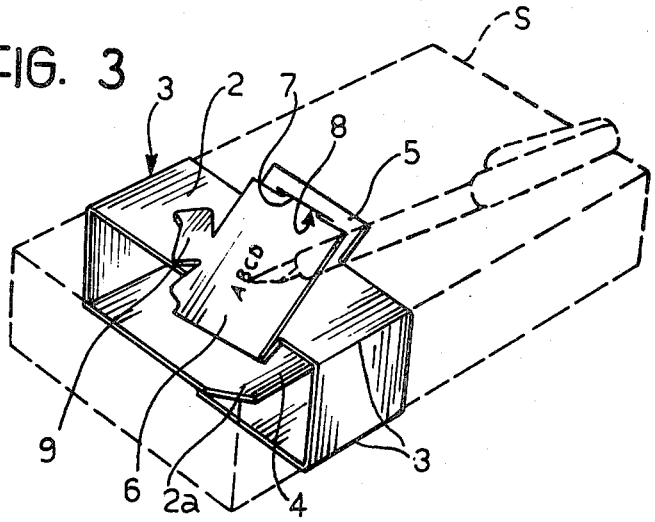

Referring to FIG. 1, a device according to the invention for appending messages to a box or package is generally indicated 1. The device 1 comprises a band or strip element 2 which as illustrated in FIGS. 2 and 3, is intended to be wrapped around a package S. In the example of use illustrated, the package S is a parallelepiped shaped box, of small depth, of the type commonly used for packaging sweet products such as chocolates and candies. The package S may in general have any prismatic shape.

In order to facilitate the wrapping of the strip element 2 around the package S, the strip element 2 is provided with fold lines or creases 3 in positions corresponding to the edges of the package S.

After the wrapping of the strip element 2 around the package S, the ends of the strip element 2 are connected together to secure the device 1 firmly to the package S. For this purpose, one face of the strip element 2 at one end, indicated 2*a*, is provided with an adhesive coating 4.

The strip element 2 incorporates a label 5 provided with a flap 6 which can be folded over the remaining part of the label 5. The label 5 is of generally rectangular shape and extends such that its longitudinal and transverse axes are inclined to the longitudinal median line of the strip element 2.

The flap 6 is further provided with a tongue 7 for engaging a corresponding aperture 8 formed in the body of the label 5 to keep the flap 6 in its folded-over position in which it overlies the remaining part of the label 5.

The flap 6 includes an integral shaped part indicated 9 the profile of which reproduces the profile of a bow of decorative ribbon.

As illustrated schematically in FIG. 2, the label 5 constitutes a writing surface for receiving a message on the package S.

The label 5 may thus easily be used by the purchaser of the package S for appending a greeting or other message for the addressee of the package. Thus the device according to the invention may be attached to the package S during its production and sold therewith; alternatively the device according to the invention may be sold separately and applied to the package S by the purchaser of the package.

After a message has been written on the the part of the label 5 resting on the flat surface of the package S the flap 6 may be folded over the remaining part of the label 5, as illustrated in FIG. 3, so that the message on this part is covered. By tucking the tongue 7 in the aperture 8 the flap 6 is held in its folded-over position covering the remaining part of the label 5.

As illustrated in FIG. 3, the surface of the flap 6 which, in its folded position, faces outwardly of the package S constitutes a further writing surface which can receive a further message, such as, for example, a recipient's address.

The oblique disposition of the main axes of the label 5 relative to the median line of the strip element 2 is such as to reproduce the approximate disposition of a separate greetings card applied in the usual manner to the package S by inserting the card beneath a conventional ribbon wrapped around the package.

Preferably, as illustrated in FIG. 3, the connection of the flap 6 to the remaining part of the label 5 is such that, when the flap is in its folded-over position, the flap 6 covers the remaining part of the label 5 only approximately.

We claim:

1. A device for appending messages to a package of prismatic shape having edges, comprising; an elongated strip element with two ends and a longitudinal axis, the strip element capable of being wrapped around the package, the strip element incorporating an enlarged portion providing a label constituting a surface for receiving a message, and a foldable integral flap extending generally transversely from the longitudinal axis of the strip element, the integral flap being foldable along a fold line so that when folded, the integral flap extends over a message-receiving part of the label so as to cover the message part with an inner face of the integral flap, while allowing apposition of a further communication to an outer face of the flap which faces outwardly of the package in a fold-over position of the flap, the integral flap and remaining portion of the label having complementary interengageable portions which, upon interengagement, keep the flap in its folded-over position.

2. A device as defined in claim 1 wherein the flap in the folded-over position leaves at least a portion of the interengaging portion providing a label uncovered.

3. A package of parallelopipedal shape provided with an elongated strip element wrapped around the package and contacting four sides of the package, the strip element completely wrapped around four sides of the package and providing an endless strip around four sides of the package, the strip being elongated to provide a generally elongated rectangular portion having an axial length and sides, an integral portion of the strip being enlarged to form an enlarged label with a message-bearing area thereon, the enlarged label portion extending from both sides of the elongated strip in a direction at an angle to the length of the strip, the enlarged label portion extending to a greater extent on one side of the strip than the other in order to form a foldable flap which is integral with the enlarged label portion, a fold line in the enlarged label portion to allow the integral foldable flap to be folded over the message-bearing area of the enlarged label portion, the fold line extending at an angle to the axial length of the strip so that the foldable integral flap covering the message-bearing area simulates a gift card attached to a package encircling wrapper.

* * * * *